US011619895B2

(12) United States Patent
Seemann et al.

(10) Patent No.: US 11,619,895 B2
(45) Date of Patent: Apr. 4, 2023

(54) SERVICING A DRUM AT A PRINTER

(71) Applicant: Hewlett-Packard Development Company, L.P., Spring, TX (US)

(72) Inventors: Ziv Seemann, Ness Ziona (IL); Erez Heldy, Ness Ziona (IL); Dror Halawa, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/414,700

(22) PCT Filed: Jul. 31, 2019

(86) PCT No.: PCT/US2019/044283
§ 371 (c)(1),
(2) Date: Jun. 16, 2021

(87) PCT Pub. No.: WO2021/021147
PCT Pub. Date: Feb. 4, 2021

(65) Prior Publication Data

US 2022/0334518 A1 Oct. 20, 2022

(51) Int. Cl.
*G03G 15/16* (2006.01)
*G03G 21/00* (2006.01)

(52) U.S. Cl.
CPC ..... *G03G 15/168* (2013.01); *G03G 15/162* (2013.01); *G03G 15/165* (2013.01); *G03G 15/166* (2013.01); *G03G 15/1655* (2013.01); *G03G 21/0005* (2013.01); *G03G 21/0052* (2013.01); *G03G 21/0088* (2013.01); *G03G 2215/1614* (2013.01); *G03G 2215/1619* (2013.01); *G03G 2215/1647* (2013.01); *G03G 2215/1652* (2013.01); *G03G 2215/1657* (2013.01); *G03G 2221/0084* (2013.01); *G03G 2221/1642* (2013.01)

(58) Field of Classification Search
CPC ..... G03G 15/162; G03G 15/165; G03G 15/1655; G03G 15/166; G03G 15/168; G03G 21/0005; G03G 21/0052; G03G 21/0088; G03G 2215/1614; G03G 2215/1619; G03G 2215/1647; G03G 2215/1652; G03G 2215/1657; G03G 2221/0084; G03G 2221/1642
See application file for complete search history.

(56) References Cited

U.S. PATENT DOCUMENTS 5,214,479 A * 5/1993 Lindblad ..... G03G 15/168 15/1.51
5,861,052 A 1/1999 Meinander
(Continued)

FOREIGN PATENT DOCUMENTS

WO 2014/008950 A1 1/2014

*Primary Examiner* — Joseph S Wong

(57) ABSTRACT

In an example of the disclosure, service rotation of a drum along a longitudinal axis of the drum is caused. The service rotation is to apply a centrifugal force upon a liquid held by the drum. The centrifugal force pushes gas bubbles in the drum away from a curved surface of the drum and towards the longitudinal drum axis. The gas bubbles evacuate from the drum via an outlet tube positioned adjacent to the longitudinal drum axis. A production rotation of the drum is caused after the service rotation.

15 Claims, 10 Drawing Sheets

(56) References Cited

U.S. PATENT DOCUMENTS

| | | | | |
|---|---|---|---|---|
| 6,259,873 | B1 * | 7/2001 | Shifley | G03G 15/751 399/117 |
| 6,523,579 | B1 | 2/2003 | Tham | |
| 6,556,796 | B1 | 4/2003 | Chavez et al. | |
| 6,626,528 | B2 | 9/2003 | Tsukuda | |
| 7,229,149 | B2 | 6/2007 | Wotton et al. | |
| 8,121,517 | B2 | 2/2012 | Asanuma et al. | |
| 8,529,032 | B2 | 9/2013 | Indorsky et al. | |
| 8,529,040 | B2 | 9/2013 | Yamamoto et al. | |
| 8,690,302 | B2 | 4/2014 | Paschkewitz et al. | |
| 8,919,939 | B2 | 12/2014 | Paschkewitz et al. | |
| 2007/0147861 | A1 | 6/2007 | Takayanagi | |
| 2008/0273064 | A1 | 11/2008 | Ota et al. | |
| 2010/0304285 | A1 * | 12/2010 | Yu | G03G 15/162 250/492.1 |
| 2013/0045022 | A1 | 2/2013 | Zhang et al. | |

* cited by examiner

Service Rotation Engine
Production Rotation Engine
106
108
408
110
404
406
102
402
100
104
204

Service Rotation Engine
Production Rotation Engine
106
108
408
110
404
406
502
102
100
104
204
206

SERVICING A DRUM AT A PRINTER

BACKGROUND

A printer may apply print agents to a paper or another substrate to produce an image upon the substrate. One type of printer is a web-fed (sometimes referred to as a "roll-fed") printer, wherein print application components apply the print agents to a web substrate fed to the printer by a substrate roll feeder system. After application of the print agents, the printed upon substrate may be collected on a take-up reel or drum, or cut into sheets.

DRAWINGS

DETAILED DESCRIPTION

Figure 1:
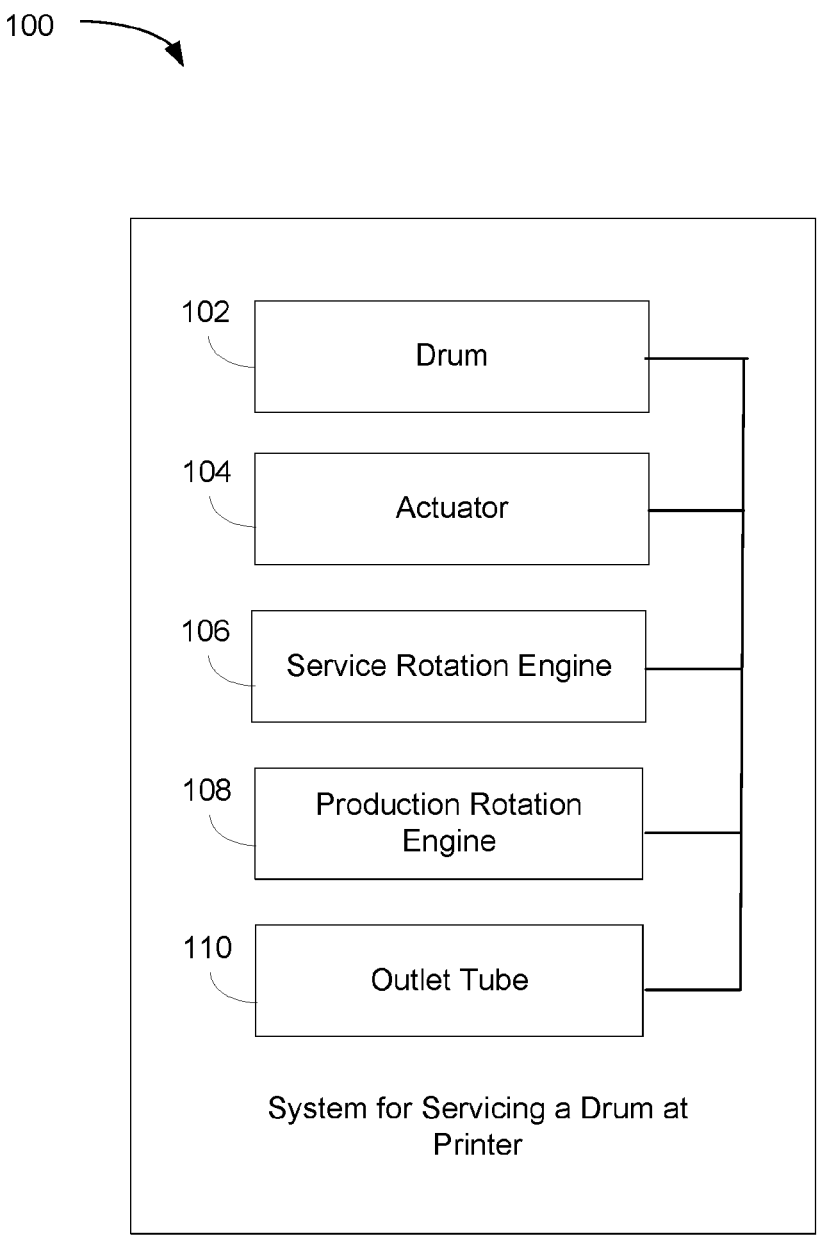
FIG. 1 is a block diagram depicting an example of a system for servicing a drum at a printer.

In certain examples, print application components of a web-fed printer may include a print agent application cylinder, an intermediate transfer member (referred to herein as an "ITM"), and an impression drum. The print application cylinder is to apply a print agent, e.g., an ink, to the ITM. In examples, the print agent application cylinder may be a plate cylinder as used offset printing, or may be a photoconductor cylinder as utilized in liquid electrophotography ("LEP") digital printing. The ITM is to in turn apply the print agent to a first side of a substrate. A rotatable impression drum is to apply pressure to the second side of the substrate and thereby cause the first side of the substrate to press firmly against the ITM during a production printing operation.

In examples, the rotatable impression drum may be filled with water or other liquid so as to allow for cooling of the drum to influence or control the temperature of the substrate during a production printing operation. However, under conventional processes during the introduction of water into the impression drum air often becomes trapped in the drum creating air bubbles. These air bubbles will move to the top of the drum and lower the heat transfer efficiency of the drum, as the bubbles cause s areas of the drum surface to have no water-to-drum surface contact. Accordingly, the impression drum may have "hot spots" where the temperature control of the drum, and in turn, of the substrate as it contacts the ITM, can be inconsistent or even ineffective.

Further, the presence of air bubbles in a water-filled impression drum can cause turbulence inside the drum as the impression drum is rotated. During production printing operations the impression drum may be, e.g., to avoid contact with a seam of the ITM, caused to rapidly decelerate, accelerate, and/or change drum rotation directions. Turbulence of the water inside the drum due to air bubbles can thus cause a lack of precision as to rotation of the drum and the pressure at which the substrate contacts the ITM.

The issues of inconsistent drum heating and turbulence caused by air bubbles in an impression drum can be highly impactful to the printer. Print quality may be diminished, and substrate and print agent may be wasted where reprinting is necessary. Further, the turbulence issue can damage the impression drum and/or the ITM, resulting in costs associated with printer downtime and costs to replace damaged equipment.

To address these issues, various examples described in more detail below provide a system and a method for servicing an impression drum and other drums to be used at a printer. In an example, a system for servicing a drum includes a drum, an actuator movably connected to the drum, a service rotation engine, a production rotation engine, and outlet tube. The service rotation engine is to cause a service rotation wherein the actuator rotates the drum around the longitudinal axis of the drum, so as to cause a centrifugal force to be imposed upon a liquid contained within the drum. The centrifugal force is for pushing push gas bubbles away from a curved surface of the drum and towards the longitudinal drum axis. The production rotation engine is to cause a production rotation wherein the actuator rotates the drum in a printing operation following the service rotation. The outlet tube is positioned adjacent to a circular plane surface of the drum and is aligned with the longitudinal drum axis. The outlet tube is to allow the gas bubbles to escape the drum during the service rotation.

In an example, the disclosed system for servicing a drum includes an inlet tube, the inlet tube having an ejection port situated inside the drum. The inlet tube is for directing liquid into the drum, as the outlet tube allows the liquid to leave the drum. In this manner the liquid is circulated through the drum in a non-vacuum environment. In an example, the inlet tube has a length that is positioned within the drum and along the central axis of the drum. In a particular example, the length of the inlet tube that is inside the drum is a length that is positioned concentrically inside of the outlet tube.

In an example, the disclosed method for servicing a drum includes causing a service rotation of a drum along a longitudinal drum axis. Liquid is added to the drum through the inlet tube and removed through the outlet tube such. This concurrent adding and removal of liquid causes a circulation of liquid through the drum and can cause the formation of air bubbles. The service rotation is to apply a centrifugal force upon the liquid and thereby push the gas bubbles away from a curved surface of the drum and towards the longitudinal drum axis. The air bubbles evacuate from the drum via an outlet tube positioned adjacent to the longitudinal drum axis. Following the service rotation, a production rotation of the drum is caused to occur in connection with a production printing operation, e.g., the forming of a printed image upon a substrate supported by the impression drum. In a particular example the production printing operation is a digital printing operation conducted at an LEP printer, wherein an ITM receives the inked image from a photoconductive surface.

In this manner, the disclosed system and method provide for effective and efficient removal of air bubbles from an impression drum or other drum at a printer. The disclosure, when integrated within a web-fed printer, can reduce or limit print quality issues and wasted supplies that can result from unequal heating, hot spots, and/or drum turbulence at an impression drum. Users and providers of printing devices will also appreciate the reductions in damage to impression drums, ITMs, and other printer components and the reductions in downtime afforded by elimination of air bubbles from the impression drum. Installations and utilization of printers that include the disclosed method and system for servicing a drum should thereby be enhanced.

Figure 2:
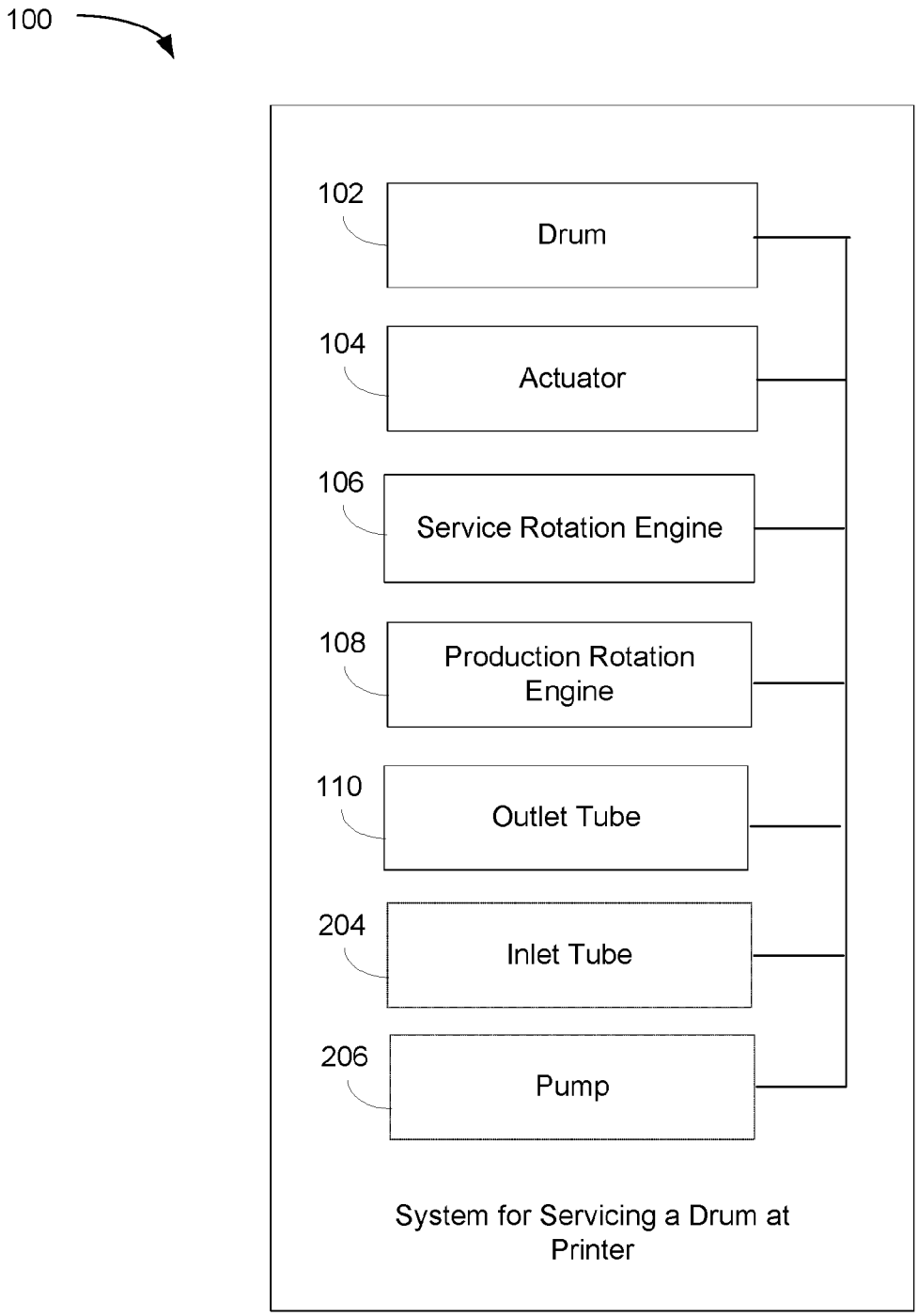
FIG. 2 is a block diagram depicting another example of a system for servicing a drum at a printer.

FIGS. 1 and 2 depict examples of physical and logical components for implementing various examples. In FIGS. 1 and 2 various components are identified as engines 106 and 108. In describing engines 106 and 108 focus is on each engine's designated function. However, the term engine, as used herein, refers generally to hardware and/or programming to perform a designated function. As is illustrated with respect to FIG. 3, the hardware of each engine, for example, may include one or both of a processor and a memory, while the programming may be code stored on that memory and executable by the processor to perform the designated function.

FIG. 1 is a block diagram depicting an example of a system 100 for servicing a drum at a printer. In this example, system 100 includes a drum 102, an actuator 104, a service rotation engine 106, a production rotation engine 108, and an outlet tube 110. As used herein a "drum" refers generally to any cylindrical container. In certain examples a drum may likewise be referred to as a cylinder, canister, or barrel. In examples, drum 102 may be formed from a metal, a plastic, a rubber-based substance, or any other durable material formed in a cylindrical shape with a smooth surface for interfacing with a substrate.

As used herein, a "substrate" refers generally to any media or surface upon which a print agent is to be applied to form a printed image. In examples, a substrate may be a web substrate, e.g., wherein a continuous web is fed from a feeding roller, through or past a print agent application component, and then collected at a collection roller. In other examples, a substrate may be in a sheet or page form that is to pass through or by a print agent application component. In examples the substrate may be or include, but is not limited to, paper, photo paper, canvas, fabric, synthetics, cardstock, cardboard, and/or corrugated material.

Actuator 104 is movably connected to drum 102. As used herein an "actuator" refers generally to any element or component that is responsible for causing movement in a mechanism or system. In an example, actuator 104 may include a power supply, a motor, gears, and a rotating rod or shaft.

Continuing with the example of FIG. 1, service rotation engine 106 represents generally a combination of hardware and programming to cause a service rotation of drum 102, wherein actuator 104 rotates drum 102 around a longitudinal axis of drum 102. As used herein, a "longitudinal" drum axis refers generally to an axis of the cylindrical drum that runs along the length of the drum. In an example, during the service rotation drum 102 is oriented with its longitudinal axis being a horizontal axis. As used here, a "horizontal axis" refers generally to an axis that is parallel to the plane of the horizon. The service rotation of drum 102 is to cause a centrifugal force to be imposed upon a liquid (e.g., water) contained within drum 102. The centrifugal force for pushing any gas (e.g., air) bubbles that are mixed with the liquid away from a curved surface drum 102 and towards the longitudinal drum axis.

As used herein, a "service rotation" of a drum at a printer is a printing operation wherein the drum is rotated as part of a servicing or other operation at a printer that does not include transfer of a print agent to a substrate. As used herein, a "printing operation" refers generally to an operation at a printer. One example of a service rotation of drum 102 is a rotation to remove air bubbles between production rotations of drum 102. Another example of a service rotation of drum 102 is a rotation of drum 102 that is part of a null cycle operation at the printer.

As used herein, a "printer" is synonymous with a "printing device" or "printing apparatus", and refers generally to any electronic device or group of electronic devices that consumes the print agent to produce a printed print job or printed content. In examples, a printer may be, but is not limited to, an offset press, a liquid a liquid toner-based printer, an LEP printer, a solid toner-based printer, an inkjet printer, a jet-on-blanket inkjet printer, or a multifunctional device that performs a function such as scanning and/or copying in addition to printing.

As used herein, a "print job" refers generally to content, e.g., an image, and/or instructions as to formatting and presentation of the content sent to a computer system for printing. In examples, a print job may be stored in a programming language and/or a numerical form so that the job can be stored and used in computing devices, servers, printers and other machines capable of performing calculations and manipulating data. As used herein, an "image" refers generally to a rendering of an object, scene, person, or abstraction such text or a geometric shape.

As used herein, "print agent" refers generally to any substance that can be applied upon a substrate by a printer during a production printing operation, including but not limited to inks, primers and overcoat materials (such as a varnish). As used herein an "ink" refers generally to a fluid that is to be applied to a substrate during a printing operation to form an image upon the substrate.

Outlet tube 110 is a tube positioned adjacent to a circular plane surface of the drum and aligned with the longitudinal axis of drum 102. As used herein, a "tube" refers generally to a hollow cylinder for holding or transporting something, e.g., a liquid or gas. In examples, tube 102 may be, or may include, of metal, plastic, or glass. Outlet tube 100 is to allow any gas bubbles that are located in drum 102 to escape drum 102 during the service rotation.

Continuing with the example of FIG. 1, production rotation engine 108 represents generally a combination of hardware and programming to cause a production rotation of drum 102, wherein actuator 104 rotates drum 102 in a production printing operation following the service rotation. In an example, the production rotation is a rotation of drum 102 along an axis that is horizontal and is a longitudinal axis of drum 102. As used herein, a "production printing operation" refers generally to an operation at a printer wherein print agent is being transferred to a substrate. As used herein, a "production rotation" of a drum at a printer is a printing operation wherein the drum is rotated as print agent is being transferred to a substrate.

FIG. 2 is a block diagram depicting another example of a system for servicing a drum at a printer. In this example system 100 includes, in addition to components 102-110 discussed with respect to FIG. 1, an inlet tube 204 and a pump 206.

Inlet tube 204 is for adding or directing liquid into the drum. In an example, inlet tube 204 includes an ejection port ejection port that is situated inside drum 102. In an example, inlet tube 204 situated along the longitudinal drum axis. In a particular example, inlet tube 204 is to direct liquid into drum 102 at the same time that outlet tube 110 is allowing liquid to leave drum 102. In this manner, the liquid is caused to circulate through the drum in a non-vacuum environment. In examples, the gas bubbles that exist in drum 102 are bubbles that formed in drum 102 as the liquid is being circulated.

Continuing at FIG. 2, pump 206 represents generally any combination of hardware and/or programming to drive the liquid through inlet tube 204 and into drum 102. In an example, pump 204 is connected to inlet tube 204 and is to water and is to drive the liquid from an external reservoir and through inlet tube 204 to enter drum 102.

In the foregoing discussion of FIGS. 1 and 2, service rotation engine 106 and production rotation engine 108 were described as combinations of hardware and programming. Engines 106 and 108 may be implemented in a number of fashions. Looking at FIG. 3 the programming may be processor executable instructions stored on a tangible memory resource 330 and the hardware may include a processing resource 340 for executing those instructions. Thus, memory resource 330 can be said to store program instructions that when executed by processing resource 340 implement system 100 of FIGS. 1 and 2.

Memory resource 330 represents generally any number of memory components capable of storing instructions that can be executed by processing resource 340. Memory resource 330 is non-transitory in the sense that it does not encompass a transitory signal but instead is made up of a memory component or memory components to store the instructions. Memory resource 330 may be implemented in a single device or distributed across devices. Likewise, processing resource 340 represents any number of processors capable of executing instructions stored by memory resource 330. Processing resource 340 may be integrated in a single device or distributed across devices. Further, memory resource 330 may be fully or partially integrated in the same device as processing resource 340, or it may be separate but accessible to that device and processing resource 340.

In one example, the program instructions can be part of an installation package that when installed can be executed by processing resource 340 to implement system 100. In this case, memory resource 330 may be a portable medium such as a CD, DVD, or flash drive or a memory maintained by a server from which the installation package can be downloaded and installed. In another example, the program instructions may be part of an application or applications already installed. Here, memory resource 330 can include integrated memory such as a hard drive, solid state drive, or the like.

Figure 3:
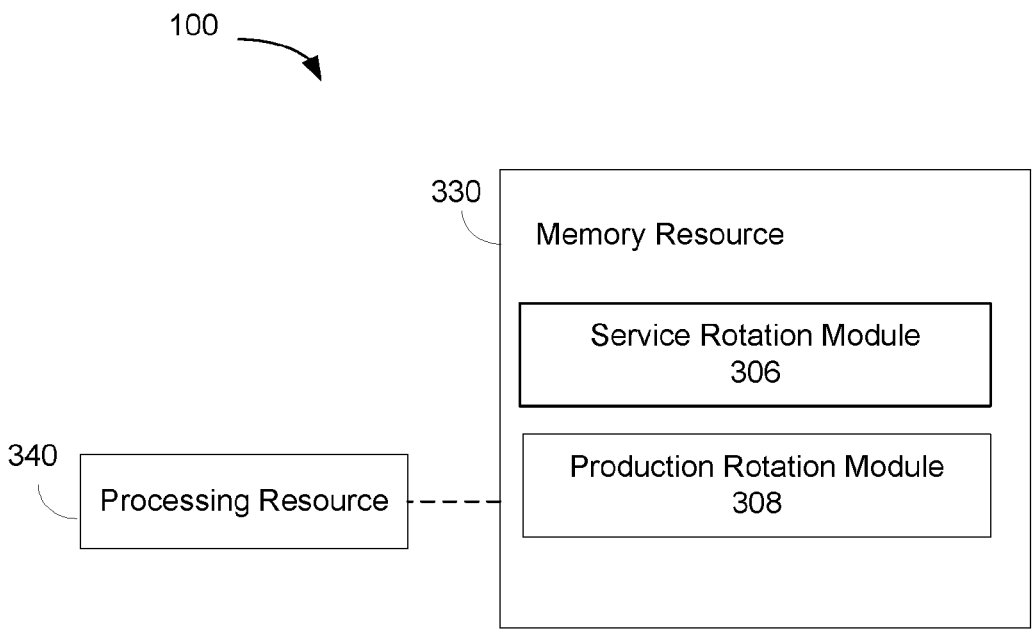
FIG. 3 is a block diagram depicting a memory resource and a processing resource to implement an example of a method for servicing a drum at a printer.

In FIG. 3, the executable program instructions stored in memory resource 330 are depicted as service rotation module 306 and production rotation module 308. Service rotation module 306 represents program instructions that when executed by processing resource 340 may perform any of the functionalities described above in relation to service rotation engine 106 of FIGS. 1 and 2. Production rotation module 308 represents program instructions that when executed by processing resource 340 may perform any of the functionalities described above in relation to production rotation engine 108 of FIGS. 1 and 2.

Figures 4A, 4B, 4C:
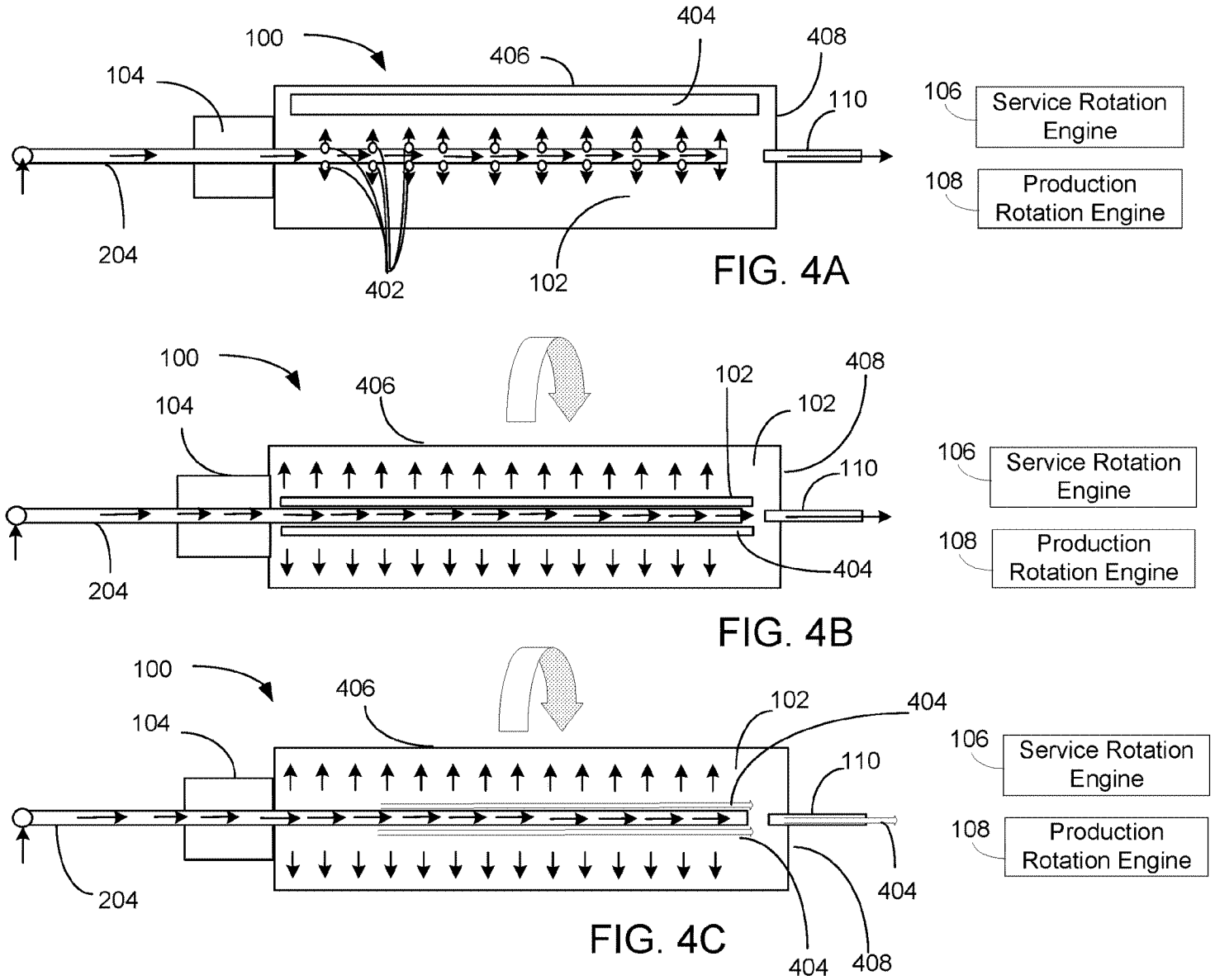
FIGS. 4A-4C are schematic diagrams that illustrate an example of a system for servicing a drum at a printer.

FIGS. 4A-4C are schematic diagrams that illustrate an example of a system 100 for servicing a drum at a printer. Beginning at FIG. 4A, in this example, system 100 includes a drum 102, an actuator 104 movably connected to the drum, an inlet tube 204, an outlet tube 110, a service rotation engine 106, and a production rotation engine 108. In this example, inlet tube 204 is for directing liquid throughout the interior of drum 102 via a set of ejection ports 402 situated inside drum 102. The movement of liquid in FIGS. 4A-4C is represented by black arrows. Ejection ports 402 are present in each of FIGS. 4A-4C, but are only visible in FIG. 4A.

Service rotation engine 108 represents a combination of hardware and programming that is to cause a service rotation of drum 102. Moving to FIG. 4B in view of FIG. 4A, actuator 104 is to rotate drum 102 along the drum's longitudinal drum axis to cause the service rotation. In examples the drum is oriented such that its longitudinal axis is a horizontal axis. The service rotation is to cause a centrifugal force to be imposed upon a liquid contained within drum 102. Moving to FIG. 4C in view of FIGS. 4A and 4B, the centrifugal force imposed upon the liquid is to push gas bubbles 404 that accumulated at the curved surface 406 of drum 102 (see FIG. 4A) away from curved surface 406 and towards the drum's longitudinal axis.

Outlet tube 110 is positioned adjacent to a circular plane surface 408 of drum 102 and is aligned with the drum's longitudinal axis. Outlet tube 110 is to allow the gas bubbles 404 to escape drum 102 during the service rotation. The movement of gas bubbles 404 is represented in FIGS. 4B-4C by arrows having a black border and a white interior.

Continuing with the example of FIGS. 4A-4D, in a particular example service rotation engine 106 is to cause a liquid to be added to drum 102 through inlet tube 204 and a liquid to be concurrently removed through the outlet tube 110 such that a quantity of liquid is to circulate through the drum in a non-vacuum environment during the service operation. In this example, gas bubbles (e.g. air bubbles) are formed in drum 102 as liquid is introduced into, and circulated throughout, the drum.

Production rotation engine 108 represents a combination of hardware and programming to cause a production rotation of drum 102, e.g., a rotation of drum that is part of a production printing operation to apply print agent to a substrate. The production rotation of drum 102 is not illustrated in FIGS. 4A-4C.

Figures 5A, 5B, 5C:
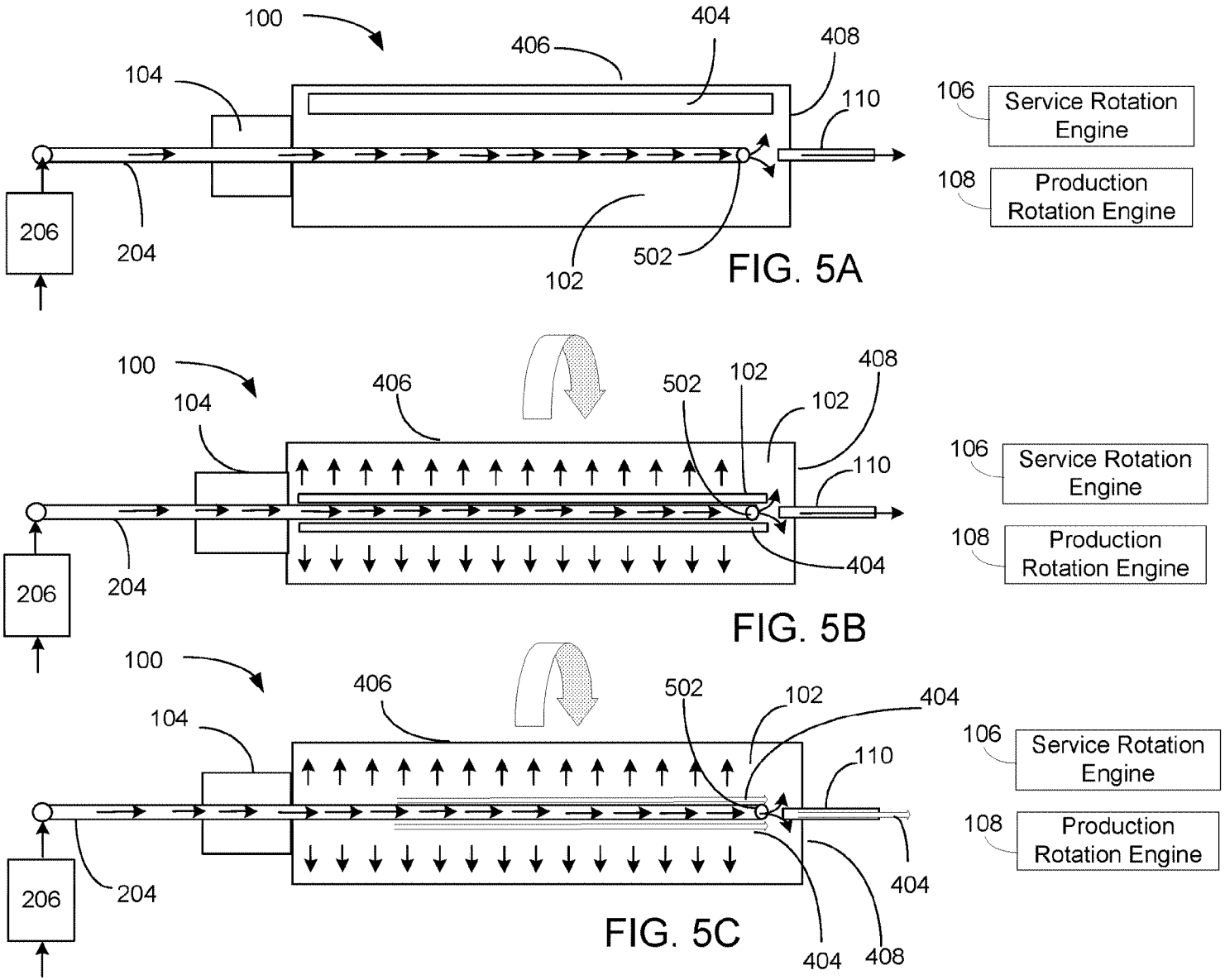
FIGS. 5A-5C are schematic diagrams that illustrate another example of a system for servicing a drum at a printer.

FIGS. 5A-5C are schematic diagrams that illustrate another example of a system 100 for servicing a drum at a printer. In the example of FIGS. 5A-5C, system 100 is substantially similar to system 100 described with respect to FIGS. 4A-4C, except that system 100 includes a pump 206 and has an outlet tube 110 with a different ejection port configuration than the outlet tube 110 of FIGS. 4A-4C. Pump 206 is connected to inlet tube 204, and is to urge liquid into drum 102 via inlet tube 204. In examples pump 206 is additionally connected to a liquid reservoir, and draws liquid from the reservoir to supply drum 102 via inlet tube 204. In the example of FIGS. 5A-5C, inlet tube 204 has a single ejection port 502 at the distal end of the inlet tube, rather than multiple ejection ports 402 along a length of inlet tube 204 as illustrated in FIGS. 4A-4C. Configurations for an ejection port or a set of ejection ports other than as depicted in FIGS. 4A-4C and 5A-5C are possible and are contemplated by this disclosure.

Figure 6A:
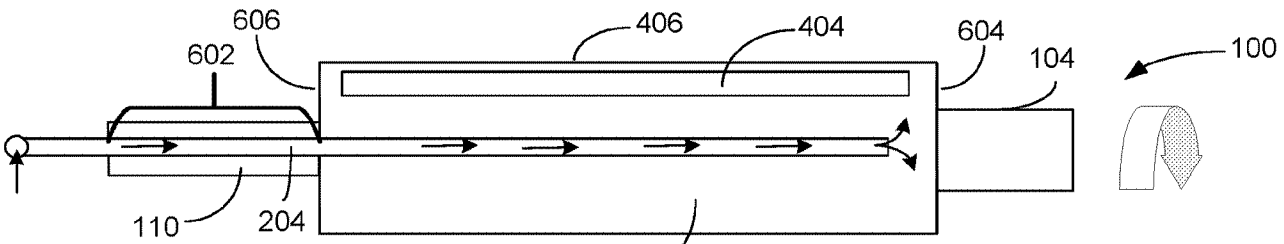
FIGS. 6A-6D are schematic diagrams that illustrate another example of a system for servicing a drum at a printer.
Figure 6B:
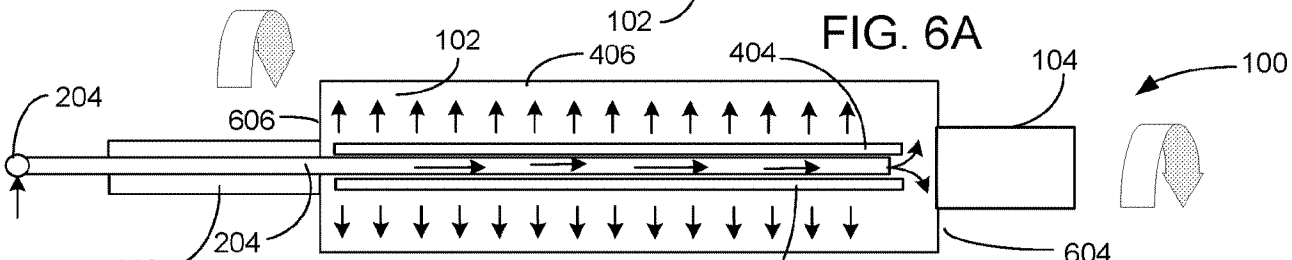
Figure 6C:
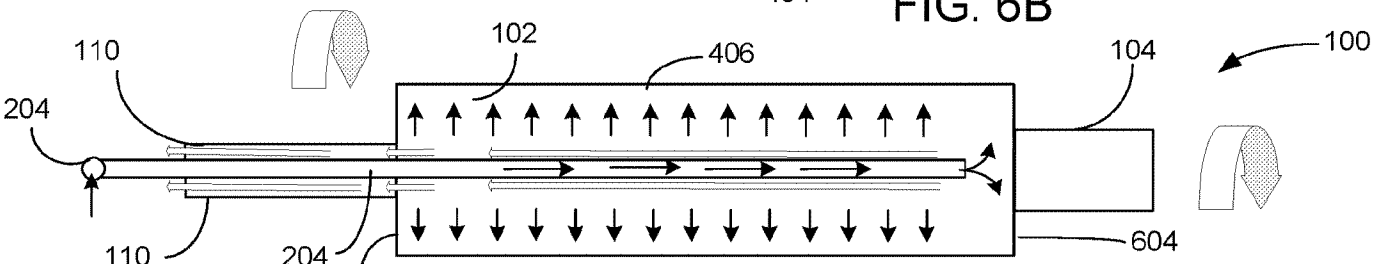
Figure 6D:
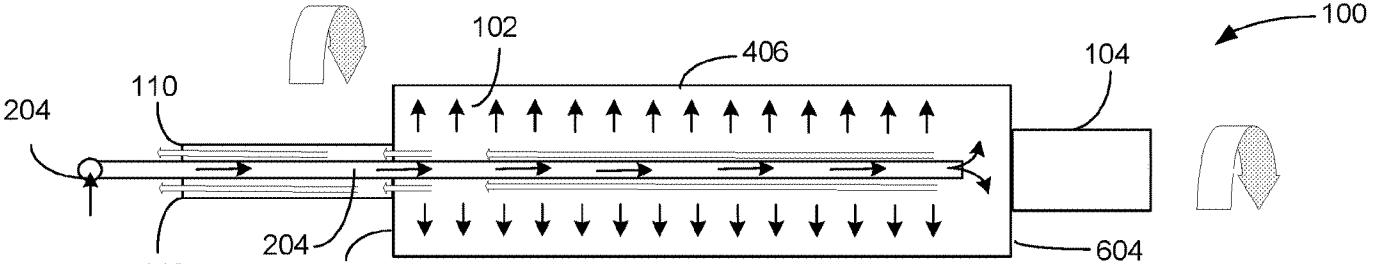

FIGS. 6A-6C are schematic diagrams that illustrate another example of a system 100 for servicing a drum at a printer. In the example of FIGS. 6A-6C, system 100 is substantially similar to system 100 described with respect to FIGS. 5A-5C, except here inlet tube 204 and outlet tube 110 are situated such that a first length 602 of inlet tube 204 lies inside of outlet tube 110. This concentric configuration for the inlet tube and the outlet tube provides benefits of conserving space in system 100, and reduces system complexity and bill of materials cost as outlet tube 110 does not extend into drum 102. In the example of FIGS. 6A-6C actuator 104 is situated adjacent to a first circular plane surface 604 of drum 102 that is opposite of a second circular plane surface 606 of drum 102 where drum 102 abuts outlet tube 110. Inlet tube 204 is for directing liquid into drum 102 so that the liquid is distributed throughout the interior of drum 102. The movement of liquid in FIGS. 6A-6C is represented by black arrows.

Continuing with the example of FIGS. 6A-6C, service rotation engine 108 is to cause actuator 104 to rotate drum 102 along the drum's longitudinal drum axis to enable the service rotation. The service rotation is to cause a centrifugal force to be imposed upon a liquid contained within drum 102. Moving to FIG. 6C in view of FIGS. 6A and 6B, the centrifugal force imposed upon the liquid is to push gas bubbles 404 that accumulated at the curved surface 406 of drum 102 (see FIG. 6A) away from curved surface 406 and towards the drum's longitudinal axis. Outlet tube 110, which surrounds inlet tube 204, is aligned with the drum's longitudinal axis and is to allow the gas bubbles 404 to escape drum 102 during the service rotation. The movement of gas bubbles 404 is represented in FIGS. 6B-6C by arrows having a black border and a white interior.

In examples service rotation engine 106 is to cause a liquid to be added to drum 102 through inlet tube 204 and a liquid to be removed through the outlet tube 110 concurrently. In this manner a quantity of liquid is to circulate through the drum in a non-vacuum environment throughout the duration of the service rotation.

In a particular example, production rotation engine 108 may also cause a liquid to be added to drum 102 through inlet tube 204 and a liquid to be removed through the outlet tube 110 concurrently. In this manner a quantity of liquid is to circulate through the drum in a non-vacuum environment throughout the duration of the production rotation. Thus, in this particular example the liquid is to circulate through drum 102 during the servicing operation to remove air bubbles from the drum, and also during a production printing operation as a printed image is formed upon a substrate supported by the drum.

In an example, during the service rotation the liquid flow into drum 102 via inlet tube 204 is between 15 L/min and 25 L/min, and the drum is rotated at between 200 and 500 rpm. In a particular example, the service rotation of drum 102 is approximately 300 rpm, with the water flow into the drum at approximately 20 L/min at a temperature of approximately 22 degrees C. With this particular example, testing revealed a temperature uniformity at the substrate contacted by drum 102 of +/−0.5 degrees C.

Figure 7A:
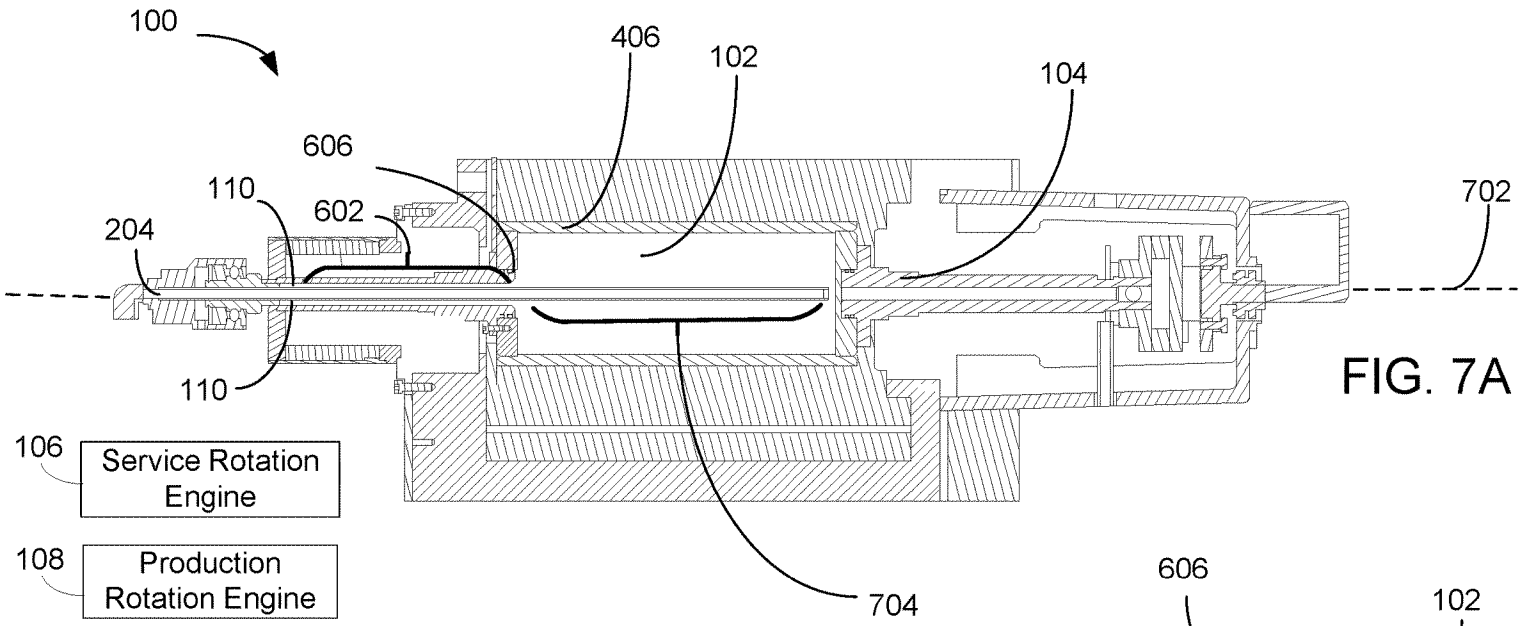
FIGS. 7A-7E illustrate another example of a system for servicing a drum at a printer.
Figure 7E:
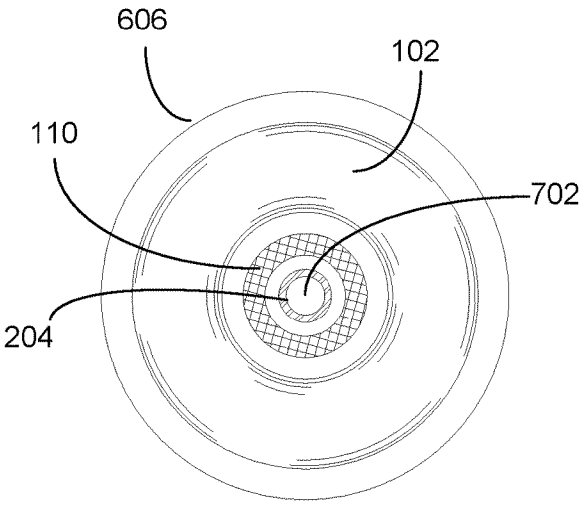
Figure 7B:
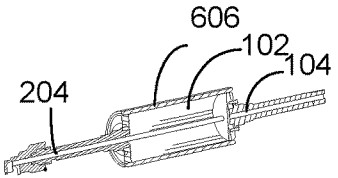
Figure 7C:
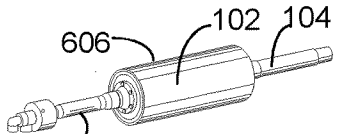
Figure 7D:
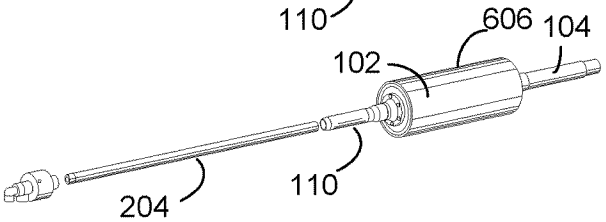

FIGS. 7A-7E illustrate another example of a system 700 for servicing a drum at a printer. FIG. 7A provides a cross section view of system 700 for servicing a drum at a printer. FIGS. 7B-7D provide perspective view of system 700, with FIG. 7B having a partial cross-section to show the interior of the drum. FIG. 7D provides an exploded view of system 700. FIG. 7E provides simplified cross section view illustrating the drum and the concentric inlet and outlet tubes of system 700.

Beginning at FIG. 7A, in this example, system 700 includes a cylindrical drum 102. Actuator 104 is movably connected to the drum such that, e.g. when urged by a motor connected actuator 104, actuator can cause rotation (e.g., a service rotation and/or a production rotation) of drum 102 along the longitudinal axis 702 of the drum. In examples longitudinal axis 702 of drum 102 is a horizontal axis.

System 700 includes a service rotation engine 106 to cause a service rotation of drum 102. During a service rotation actuator 104 is to rotate the drum around the longitudinal drum axis 702. The service rotation is to cause a centrifugal force to be imposed upon a liquid contained within drum 102. The centrifugal force is to pushing push gas bubbles away from a curved surface 406 of drum 102 and towards the drum's longitudinal axis 702.

System 700 includes a production rotation engine 108 to cause a production rotation of drum 102 after the service rotation. During a production rotation actuator 104 rotates drum 102 to support a substrate during application of a print agent to form a printed image upon the substrate.

System 700 includes an outlet tube 110 positioned adjacent to a circular plane surface 606 of drum 102 and aligned with the drum's longitudinal axis 702. Outlet tube 110 is to allow any gas bubbles in drum 102 to escape the drum during the service rotation.

System 700 includes an inlet tube 204 with an ejection port situated inside the drum. In one example the ejection port (not shown in FIGS. 7A-7E) may be a single ejection part at an end of inlet tube 204 situated within drum 102. In another example, the ejection port may one of a set of ejection ports arranged along a second length 704 of inlet tube that is situated within drum 102.

In this example inlet tube 204 is for directing liquid into drum 102, while outlet tube concurrently enabling liquid to exit drum 102, such that liquid circulates through the drum in a non-vacuum environment. Moving to the cross section view of FIG. 7E in view of FIGS. 7A-7D, it can be seen that in this example that a first length 602 of inlet tube 204 is positioned inside a length of outlet tube 110, such that inlet tube 204 and outlet tube 110 are concentric. In this example outlet tube 110, and the first length 602 of inlet tube 204 that is surrounded by outlet tube 110, are positioned adjacent to a circular plane surface 606 of the drum and are aligned horizontally and with the drum's longitudinal axis 702.

In the example of FIGS. 7A-7E, outlet tube 110 is connected to drum 102 such that outlet tube 102 is to rotate along with drum 102 during the service rotation. In this example, inlet tube 204 is not directly connected to the drum and is not to rotate during the service rotation. In this example system 100 includes a rotary joint 706 to enable the rotation of outlet tube 102 without rotating inlet tube 204. It should be noted that in other examples, system 100 may be assembled such both outlet tube 110 and inlet tube 204 are to rotate along with drum 102, or such that neither of outlet tube 110 or inlet tube 204 is to rotate along with drum 102.

Figure 8:
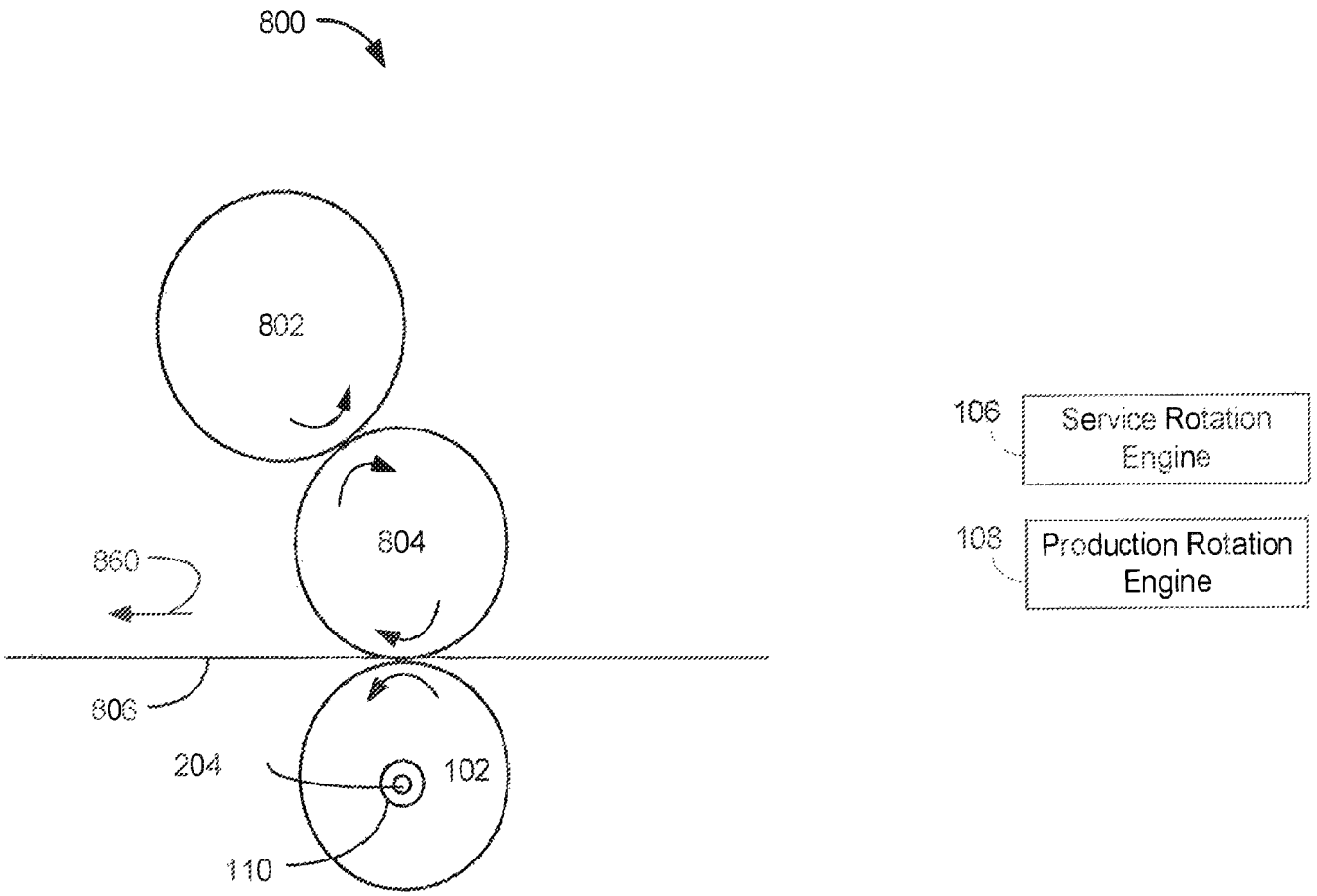
FIG. 8 is a schematic diagram that illustrates an example of a printer apparatus that includes a system for servicing a drum at a printer.

FIG. 8 is a schematic diagram that illustrates an example of a printer apparatus that includes a system for servicing a drum at a printer. In the example of FIG. 8 printing apparatus 800 includes a print application cylinder 802, an impression drum 102, an actuator, a service system for impression drum 802 including an inlet tube, a service rotation engine 106, an outlet tube 110, and a production rotation engine 108. As used herein a "print application cylinder" refers generally to any cylinder that is to transfer a developed image to an ITM. As used herein, a "developed image" refers generally to a tangible image that has been inked or otherwise formed via application of a print agent to a print application cylinder. In an example, print apparatus 800 may be an offset press and print application cylinder 802 may be a plate cylinder that receives ink or another print agent from a roller in contact with print application cylinder 802. In an example the developed image would be an inked image transferred from an inked plate cylinder to the ITM. In another example, print application cylinder 802 may be a cylinder with a photoconductive surface, as used in LEP digital printing.

Print application cylinder 802 is positioned to make a first transfer of a developed image from the print application cylinder to ITM 804. ITM 804 is positioned to, following the first transfer, make a second transfer of the developed image to a substrate 806 supported by impression drum 102. As used herein, "impression drum" refers generally to a cylinder that is used to apply pressure to a first side of a substrate and thereby cause an opposite second side of the substrate to press in a controlled manner against an ITM during a printing operation. In this example substrate 806 is a web substrate moving along a substrate path in a substrate path direction 860. In another example substrate 806 could be a sheet substrate. The actuator (not visible in FIG. 8) is to cause rotation of the impression drum 102 around a longitudinal drum axis.

Continuing with the example of FIG. 8, service rotation engine 106 is to cause an insertion of water into drum 102 via inlet tube 110, and is to cause the actuator to effect a service rotation of impression drum that is to cause a centrifugal force to be imposed upon the water. Outlet tube 110 is to allow air bubbles to escape drum 102 during the imposition of the centrifugal force. Production rotation engine 108 to cause a production rotation of the drum after the service rotation.

Figure 9:
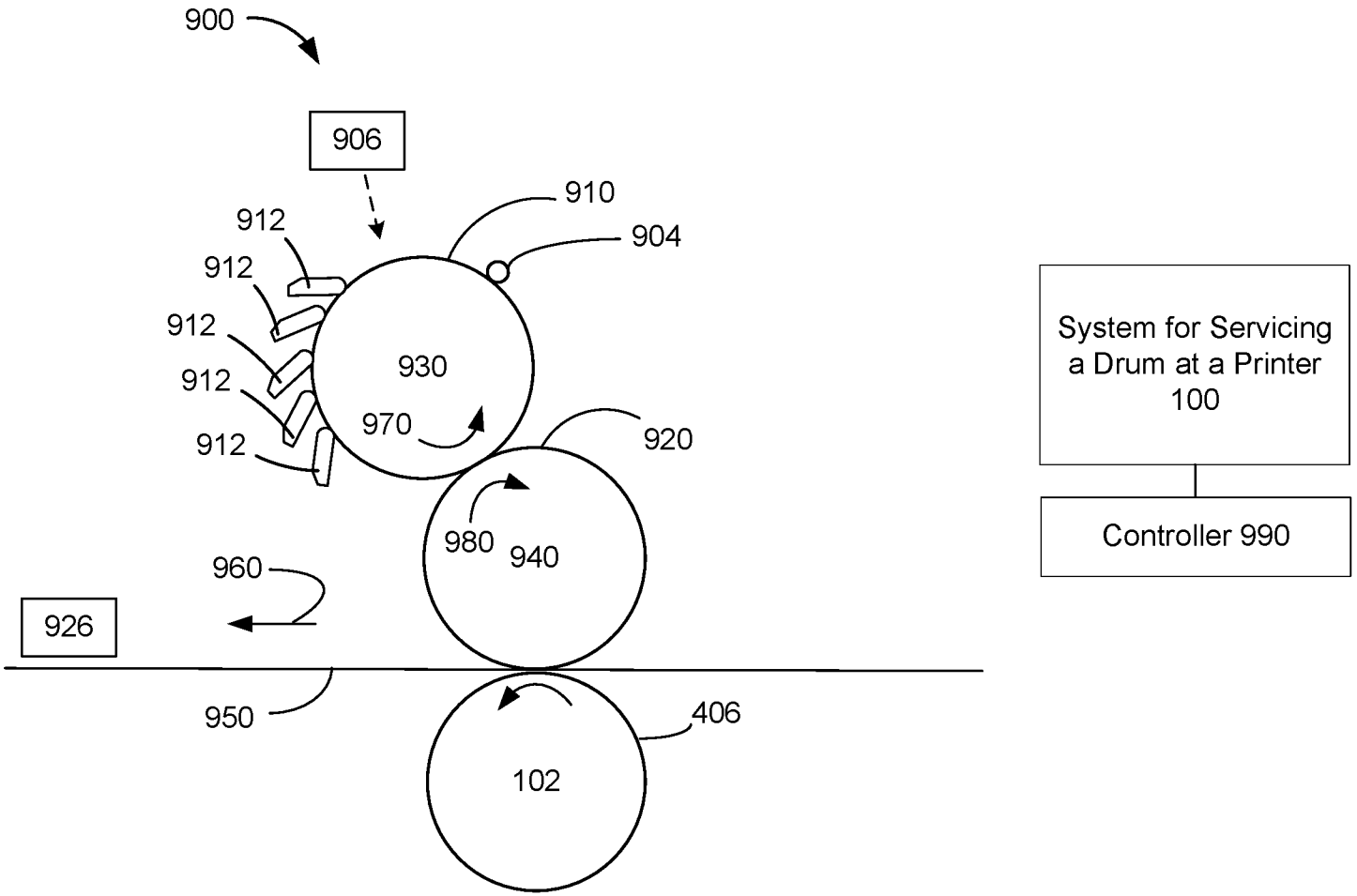
FIG. 9 is a schematic diagram illustrating an example of a liquid electrophotography printer apparatus that includes a system for servicing a drum at a printer.

FIG. 9 is a schematic diagram illustrating an example of a liquid electrophotography ("LEP") printer apparatus that includes a system for servicing a drum at a printer. In an example, an LEP printer 900 may include a print application cylinder 930 with a photoconductive surface 910, a charging device 904, a writing component 906, an ITM 920 positioned on an ITM drum 940, an impression cylinder 102, and a set of developer assemblies 912.

According to the example of FIG. 9, a pattern of electrostatic charge is formed on a photoconductive surface 910 by rotating a clean, bare segment of photoconductive surface 910 under charging device 904. Photoconductive surface 910 in this example is cylindrical in shape, e.g. is attached to print application cylinder 930, and rotates in a direction of arrow 970. In other examples, photoconductive surface 910 may be planar or part of a belt-driven system.

Charging device 904 may be or include a charge roller, corona wire, scorotron, or any other charging apparatus. A uniform static charge is deposited on photoconductive surface 910 by charging device 904. As photoconductive surface 910 continues to rotate, it passes a writing component 906 where one or more laser beams, LED, or other light sources dissipate localized charge in selected portions of photoconductive surface 910 to leave an invisible electrostatic charge pattern ("latent image") that corresponds to the image to be printed. In some examples, charging device 904 applies a negative charge to the surface of photoconductive surface 910. In other implementations, the charge is a positive charge. Writing component 906 then selectively discharges portions of the photoconductive surface 910, resulting in local neutralized regions on the photoconductive surface 910.

Continuing with the example of FIG. 9, a set of developer assemblies 912 are disposed adjacent to photoconductive surface 910 and may correspond to various print fluid colors such as cyan, magenta, yellow, black, and the like. There may be one developer assembly 912 for each print fluid color. In other examples, e.g., black and white printing, a single developer assembly 912 may be included in LEP printer 900. During printing, the appropriate developer assembly 912 is engaged with photoconductive surface 910. The engaged developer assembly 912 presents a uniform film of print fluid to photoconductive surface 910. The print fluid contains electrically-charged pigment particles which are attracted to the opposing charges on the image areas of photoconductive surface 910. As a result, photoconductive surface 910 has a developed image on its surface, i.e. a pattern of print fluid corresponding with the electrostatic charge pattern (also sometimes referred to as a "separation").

The print fluid is transferred from the photoconductive surface 910 to ITM 920. ITM 920 may be in the form of an ITM attached to a rotatable ITM drum 940. In other examples, the ITM may be in the form of a belt or other transfer system. In this particular example, photoconductive surface 910 and ITM 920 are on drums 930 940 that rotate relative to one another, such that the color separations are transferred during the relative rotation. In the example of FIG. 9, ITM 920 rotates in the direction of arrow 980. The transfer of a developed image from photoconductive surface 910 to ITM 920 may be known as the "first transfer", which takes place at a point of engagement between photoconductive surface 910 and ITM 920.

[Once the layer of print fluid has been transferred to ITM 920, it is next transferred to a print substrate 950. In this example, print substrate is a web substrate 950 moving along a substrate path in a substrate path direction 960. In other examples, the print substrate may be a sheet substrate that travels along a substrate path. This transfer from ITM 920 to the print substrate 950 may be deemed the "second transfer", which takes place at a point of engage between ITM 920 and print substrate 950. The impression cylinder 102 can both mechanically compress the print substrate into contact with ITM 920 and also help feed print substrate 950. In examples, print substrate 950 may be a conductive or a non-conductive print substrate, including, but not limited to, paper, cardboard, sheets of metal, metal-coated paper, or metal-coated cardboard. In examples, print substrate 950 with a printed image may be moved to a position to be scanned by an inline color measurement device 926, such as a spectrometer or densimeter, to generate optical density and/or background level data.

Controller 990 refers generally to any combination of hardware and software that is to control part, or all, of the LEP printer 900 components and print process. In examples, the controller 990 can control a system 100 (FIGS. 1 and 2) for servicing impression drum 102. Non-exclusive examples of a system 100 for servicing impression drum 102 at printer 900 are described in the foregoing paragraphs, including the descriptions of FIGS. 1, 2, 3, 4A-4C, 5A-5C, 6A-6C, and 7A-7E.

It should be noted that while various examples of system 100 for servicing a drum at a printer have been described herein with respect to an offset printing (e.g., at FIG. 8) and an LEP printing systems (e.g., at FIG. 9), this disclosure is equally applicable to all types of printers that utilize a drum, e.g. an impression drum, in its printing operations. Such printers may include, but are not limited to, jet-on-blanket inkjet printers and solid toner-based printers. As used herein, a "jet-on-blanket inkjet printer" refers generally to a printer that utilizes printheads (e.g., thermal printheads, piezo printheads) to cause a first transfer of print agent to an ITM, and the ITM in turn is caused to make a second transfer to a substrate. The second transfer to the substrate is a transfer of an image formed at least in part by the print agent received at the blanket.

Figure 10:
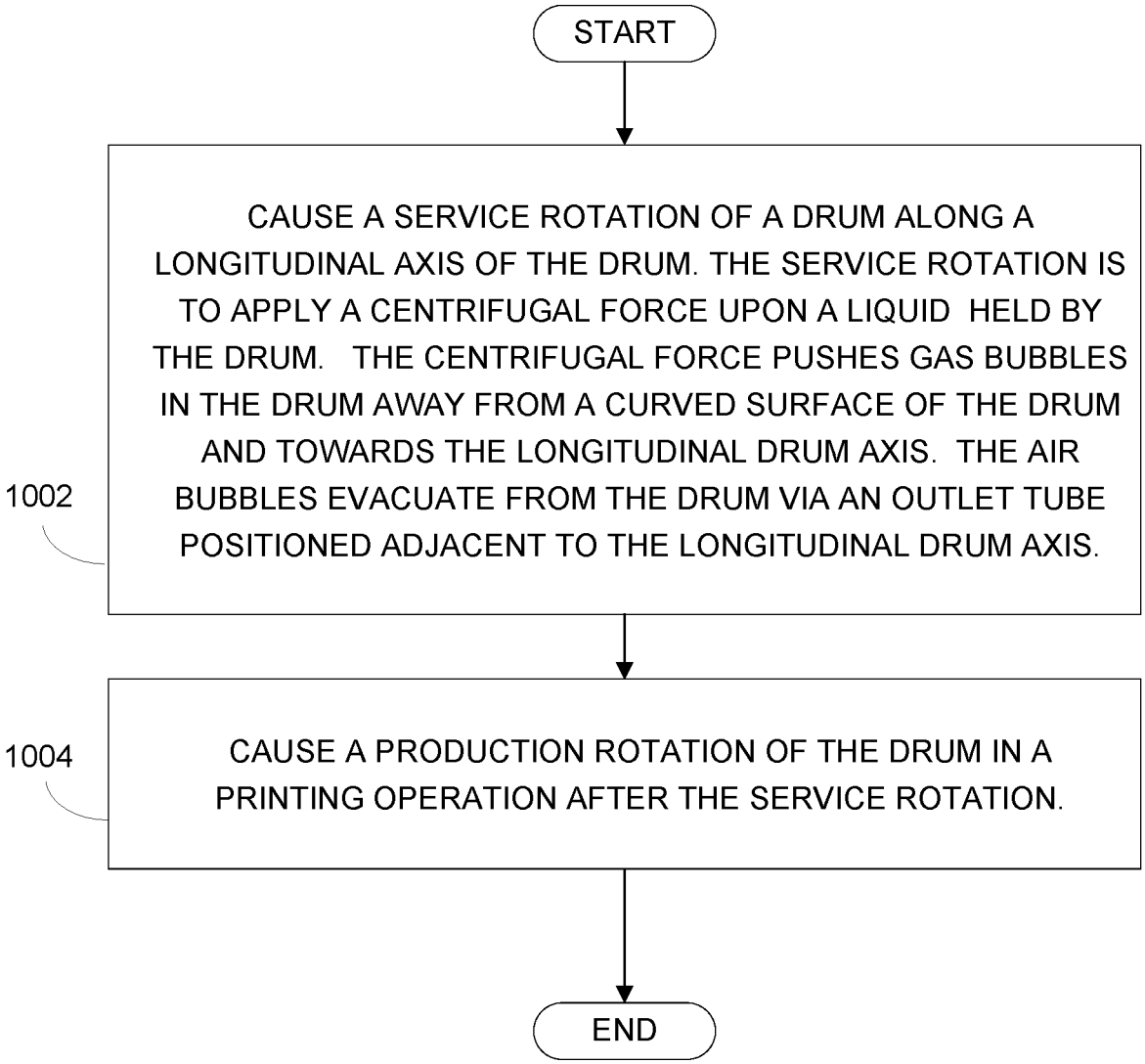
FIG. 10 is a flow diagram depicting an example implementation of a method for servicing a drum at a printer.

FIG. 10 is a flow diagram of implementation of a method for servicing a drum at a printer. A service rotation of a drum along a longitudinal drum axis is caused. The service rotation is to apply a centrifugal force upon a liquid held by the drum. The centrifugal force pushes gas bubbles in the drum away from a curved surface of the drum and towards the drum axis. The air bubbles evacuate from the drum via an outlet tube positioned adjacent to the drum axis (block 1002). Referring back to FIGS. 1, 2, and 3, service rotation engine 106 (FIGS. 1 and 2) or service rotation module 306 (FIG. 3), when executed by processing resource 340, may be responsible for implementing block 1002.

A production rotation of the drum in a production printing operation is caused to occur after the service rotation (block 1004). Referring back to FIGS. 1, 2, and 3, production rotation engine 108 (FIGS. 1 and 2) or production rotation module 308 (FIG. 3), when executed by processing resource 340, may be responsible for implementing block 1004.

FIGS. 1-10 aid in depicting the architecture, functionality, and operation of various examples. In particular, FIGS. 1-10 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 10 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A method for servicing a drum at a printer, comprising:

causing a service rotation of a drum along a longitudinal axis of the drum, the service rotation to apply a centrifugal force upon a liquid held by the drum, wherein the centrifugal force pushes gas bubbles in the drum away from a curved surface of the drum and towards the longitudinal drum axis;

wherein the gas bubbles evacuate from the drum via an outlet tube positioned adjacent to the longitudinal drum axis; and causing a production rotation of the drum after the service rotation.

2. The method of claim 1, further comprising, during the service rotation, adding liquid through the inlet tube and removing liquid through the outlet tube such that liquid circulates through the drum in a non-vacuum environment, and wherein the gas bubbles are air bubbles that form in the drum as the liquid is circulated.

3. The method of claim 2, wherein the liquid is added via an inlet tube situated along the longitudinal drum axis.

4. The method of claim 1, wherein the drum is an impression drum, and wherein the production rotation is part of a production printing operation wherein a printed image is formed upon a substrate supported by the impression drum.

5. The method of claim 4, wherein forming the printed image upon the substrate includes transferring a developed image from an intermediate transfer member ("ITM") to the substrate.

6. The method of claim 4, wherein the production printing operation is a production printing operation conducted at an LEP printer, and wherein the ITM receives a developed image from a photoconductive surface and the developed image is transferred from the ITM to the substrate.

7. The method of claim 1, wherein the during the service rotation the liquid flow into the drum via the inlet tube is between 15 L/min and 25 L/min, and the drum is rotated at between 200 and 500 rpm.

8. A system for servicing a drum at a printer, comprising:

a drum;

an actuator movably connected to the drum;

a service rotation engine, to cause a service rotation wherein the actuator rotates the drum around a longitudinal axis of the drum, wherein the service rotation is to cause a centrifugal force to be imposed upon a liquid contained within the drum, the centrifugal force for pushing push gas bubbles away from a curved surface of the drum and towards the longitudinal drum axis;

a production rotation engine, to cause a production rotation wherein the actuator rotates the drum to support a substrate during application of a print agent to the substrate; and an outlet tube positioned adjacent to a circular plane surface of the drum and aligned with the longitudinal drum axis, the outlet tube to allow the gas bubbles to escape the drum during the service rotation.

9. The system of claim 8, further comprising an inlet tube with an ejection port situated inside the drum, wherein the inlet tube is for directing liquid into the drum, and the outlet tube is to allow liquid to leave the drum, such that such that liquid circulates through the drum in a non-vacuum environment.

10. The system of claim 9, wherein a length of the inlet tube is positioned within the drum and along the longitudinal drum axis.

11. The system of claim 9, wherein a length of the inlet tube is positioned inside a length of the outlet tube.

12. The system of claim 9, further comprising a pump connected to the inlet tube to drive the liquid through the inlet tube and into the drum.

13. A printing system, comprising:

a print application cylinder positioned to make a first transfer of a developed image to an intermediate transfer member ("ITM");

the ITM positioned to, following the first transfer, make a second transfer of the developed image to a substrate supported by an impression drum;

the impression drum;

an actuator to cause rotation of the impression drum around a longitudinal drum axis;

a service system for the impression drum, including an inlet tube, positioned adjacent to the longitudinal drum axis;

a service rotation engine, to cause an insertion of water into the drum via an inlet tube, and to cause an actuator to effect a service rotation of the impression drum that is to cause a centrifugal force to be imposed upon the water;

an outlet tube to allow air bubbles to escape the drum during the imposition of the centrifugal force; and a production rotation engine to cause a production rotation of the drum after the service rotation.

14. The printing system of claim 13, wherein a first length of the inlet tube is positioned inside a length of the outlet tube, and wherein a second length of the inlet tube is positioned within the drum and along the longitudinal drum axis.

15. The printing system of claim 13, wherein the outlet tube is connected to the drum such that the outlet tube is to rotate with the drum during the service rotation, and the inlet tube does not rotate during the service rotation.

* * * * *